United States Patent [19]

Speisebecher et al.

[11] Patent Number: 4,637,745

[45] Date of Patent: Jan. 20, 1987

[54] MELT DISPENSERS

[75] Inventors: Joachim Speisebecher, Oberursel; Christian Wooge, Bad Homburg, both of Fed. Rep. of Germany

[73] Assignee: USM Corporation, Flemington, N.J.

[21] Appl. No.: 755,805

[22] Filed: Jul. 17, 1985

[30] Foreign Application Priority Data

Jul. 28, 1984 [GB] United Kingdom ..... 8419303

[51] Int. Cl.[4] ..... B67D 5/32

[52] U.S. Cl. ..... 401/1; 401/2; 222/146.1; 222/146.5

[58] Field of Search ..... 401/1, 2; 222/146.1, 222/146.5

[56] References Cited

U.S. PATENT DOCUMENTS

| | | | |
|---|---|---|---|
| 3,776,426 | 12/1973 | Newton . | |
| 3,951,308 | 4/1976 | Thirtle | 222/146.5 |
| 4,014,464 | 3/1977 | Newton et al. . | |
| 4,090,643 | 5/1978 | Wilkinson, Jr. et al. | 222/146.5 |
| 4,150,770 | 4/1979 | Wieland, Jr. et al. | 222/146.5 |
| 4,552,287 | 11/1985 | Dziki | 222/146.5 |

FOREIGN PATENT DOCUMENTS

| | | |
|---|---|---|
| 0116400 | 8/1984 | European Pat. Off. . |
| 2348031 | 11/1977 | France . |
| 2364696 | 4/1978 | France . |
| 1402648 | 8/1975 | United Kingdom . |
| 1540482 | 2/1979 | United Kingdom . |
| 1562926 | 3/1980 | United Kingdom . |
| 1567679 | 5/1980 | United Kingdom . |

*Primary Examiner*—Richard J. Apley

*Attorney, Agent, or Firm*—Thomas S. Szatkowski

[57] ABSTRACT

A melt body (16) for a melt dispenser is disclosed which is particularly suitable for use in a hand held hot melt glue gun for use with rods of hot melt glue. The melt body including a melt chamber (17) provided with a series of fin elements (23) which define passageways terminating at an outlet (21). The fin elements increase in size progressively from an inlet (19) of the melt chamber to the outlet and ensure good transfer of heat to material to be melted. Edge surfaces of the fin elements provide surface portions of an opening adapted to receive the central portion of a rod as the rod is fed into the melt chamber. The shaping of the fin elements is such as to permit convenient manufacture by a die casting process. The spacing of the fin elements is selected so that melted material flows from the outlet when its viscosity has been reduced to an appropriate value to ensure good adhesive bonding. The arrangement permits improved consistency of heating the material and thus improved control of temperature of dispensed material. Also described is an improved hand held hot melt glue gun incorporation such a melt chamber, and incorporating a trigger operated feeding means (14).

16 Claims, 9 Drawing Figures

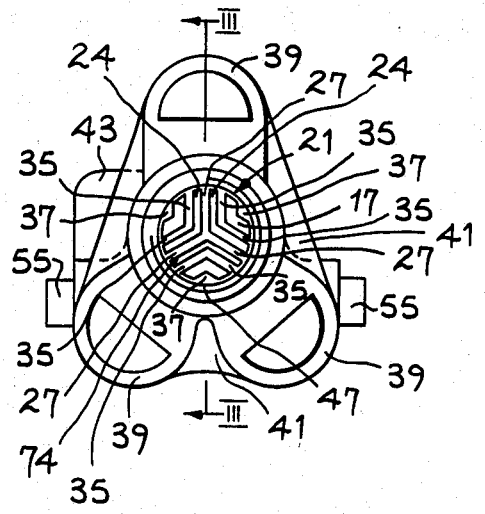
Fig_2
Fig_3
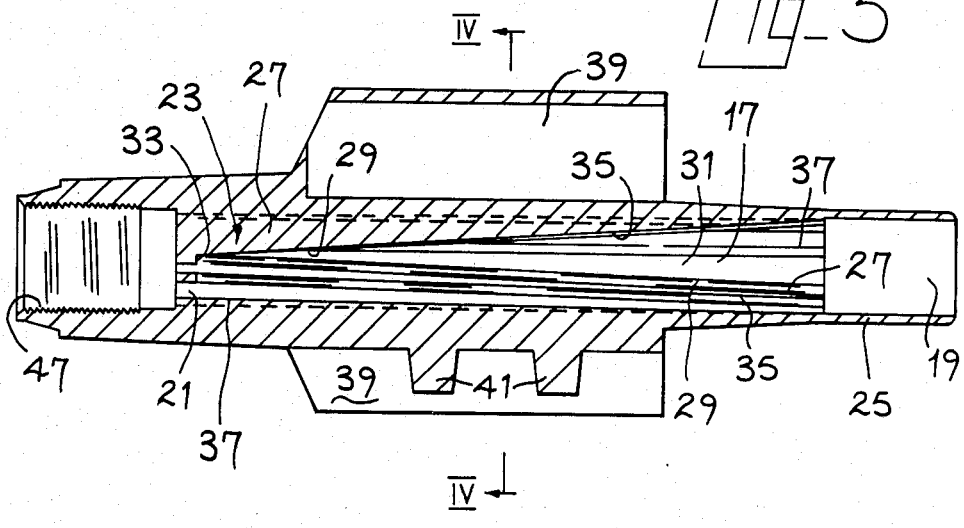
Fig_4
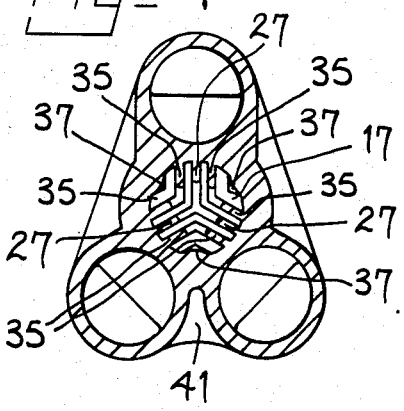

110
42
68
VI
72
71
80
44
63
61
48
70
49
64

110
42
58
79
72
79
60
60
62
62
63
48
63
44
61
44
61
70

MELT DISPENSERS

BACKGROUND OF THE INVENTION

This invention relates to melt dispensers.

Various proposals have been made to provide apparatus for melting and dispensing thermoplastic material supplied in the form of a rod. Such apparatus is usually provided with a melt body having a melt chamber in which thermoplastic material is melted, an inlet for the rod and an outlet comprising an orifice for dispensing melted material, and means for heating the melt body so that composition fed as a rod into the melt chamber may be dispensed in molten condition from the orifice. Such apparatus finds use in various fields of application, and is of particular interest in the field of applicators for hot melt adhesives and sealants and especially in hand held glue guns having provision for feeding a rod of adhesive to the melt body for example by direct thumb pressure or by trigger operated means.

PRIOR ART

The present invention is concerned with an improved melt body for melting and dispensing hot melt compositions, and apparatus incorporating such melt bodies.

GB patent specification No. 1402648 discloses that in order to increase the rate of heating and melting of thermoplastic material in a melting chamber the surface area of melting chamber in contact with the material may usefully be increased by giving a portion of the melting chamber a cross-sectional shape defined by an undulatory perimeter, so that, for example, that portion of the chamber is substantially W or V-shaped in cross-section.

While glue guns according to GB No. 1402648 provide an enhanced delivery of melt as compared with earlier models of glue gun, further attempts have been made to achieve enhanced delivery of melted material by use of so called by-pass channels, for example as disclosed in GB Patent Specification No. 1562926. Even with such improved melt chambers delivery of about 17 g of melt per 60 seconds is the approximate maximum delivery under conditions of continual feed of rod to the melt chamber and this value is substantially lower than the delivery required for many modern industrial uses.

If increased feed pressure is applied to the solid rod entering the melt chamber, in an attempt to increase the rate of melt delivered from usual forms of melt chamber e.g. as disclosed in GB No. 1402648 and GB No. 1562926, there is a tendency for the material to be passed through the melt chamber quickly, but the heating of portions of the material becomes correspondingly less with the results that the difficulty of extruding the melt is increased and also the ability to form good bonds may be reduced. In other words, the material is inconsistently heated, and thus delivered at inconsistent temperatures which may lead to defective bonds or indeed in extreme cases for solid rod to be forced through the outlet of some melt chambers with consequent risk of damage to flow control valves if present at the outlet.

Application of hot melt materials e.g. adhesives, on a scale and with a frequency required for industrial use requires a suitably strong and reliable apparatus capable of delivering comparatively large amounts of melt in bond forming condition and at a uniform condition on demand as and when required. Important features in relation to these requirements include the rate at which solid material may be converted into melted material and the consistency with which melt may be extruded at acceptably uniform temperatures. It is also important that the apparatus be comparatively inexpensive to manufacture and also, in the case of hand held apparatus, that the equipment should be of comparatively light weight and easy to wield.

BRIEF SUMMARY OF THE INVENTION

Among objects of the invention are to provide an improved melt body and to provide an improved melting and dispensing apparatus and especially an improved hot melt glue gun.

The present invention provides in one of its aspects a heat conductive melt body comprising a chamber for melting solid composition provided in the form of a rod the chamber having an inlet through which a rod of composition may be inserted into the chamber and an outlet from which melted composition may be dispensed, fin elements disposed lengthwise within the chamber and of progressively increasing size considered in a direction extending from the inlet to the outlet, the fin elements being so shaped and located that edge surfaces thereof disposed towards an interior of the chamber define surface portions of an opening of progressively reducing cross section the peak of which opening is located adjacent to the outlet but on the inlet side thereof and so that end portions of the fin elements at the outlet are spaced to define a series of exit slots spaced about an axis of the opening to provide the outlet, and at least one housing for receiving electrically operated heating means for heating the melt body.

The inlet of a melt body according to the invention is most suitably of a cross-section similar to the cross-section of a rod of composition which is intended to be fed into the chamber. Preferably the inlet is circular, and also the wall surface of the chamber is preferably at least substantially circular.

The fin elements of a melt body according to the invention protrude from a wall surface of the chamber into a cavity of the melt chamber. Fin elements preferably have a plate like structure having a substantially triangular configuration. The fin elements preferably comprise three major elements of similar shape and size spatially disposed with angles of at least substantially 120° between adjacent major elements and which have portions of their larger ends joined together at the outlet, which is to say that the major elements are preferably arranged as a tripod which is effective at least towards the outlet of the melt chamber to separate the melt chamber into three sub-chambers and so that inner edge surfaces of the major elements provide surface portions of the opening of progressively reducing cross section. The opening may be for example cone-shaped, or more preferably is shaped as a pyramid of triangular section. The opening is preferably centrally disposed in the chamber and narrows to a peak located adjacent to the outlet. The fin elements preferably also comprise sub-elements disposed in pairs between adjacent major elements, which also have their larger ends joined together at the outlet. Each sub-element is preferably disposed parallel to the adjacent major element. Preferably the fin elements also comprise singular elements disposed on the wall surface of the melt chamber equidistant from adjacent major elements. Preferably the joins between the major elements and the joins between the sub-elements extend over a comparatively short length of the melt chamber, thus to provide a short outlet having a series of exit slots disposed about the axis of the melt chamber.

An important feature of a melt body according to the invention is the width of the slots or in other words the spacing between the fin elements especially at the outlet. The width of the slots is preferably at least substantially uniform and selected in relation to the melt viscosity of compositions intended to be dispensed, for we have discovered that the ability. of melted composition to flow through narrow slots is dependent upon the viscosity of the melted material being brought to a value which is characteristic of each formulation to be dispensed. Thus the width of the slots may be selected so that composition cannot escape from the chamber through the slots until the composition has been heated enough to reduce the melt viscosity to a desired value. Also, this desired value may be chosen bearing in mind that in order to produce adhesive bonds of consistently acceptable value it is desirable to achieve a melt viscosity of adhesive dispensed which is sufficient to allow adequate flow of adhesive from the nozzle as well as adequate wetting of the surfaces to which the melted adhesive material is applied. Thus by appropriate selection of dimensions of the slots one may ensure that melted composition is consistently dispensed at not less than a required viscosity, and by appropriate distribution of the fin elements within the chamber one may achieve quick and effective heating of material within the chamber.

A melt body according to the invention comprises at least one housing for receiving electrically operated heating means. We have found that good temperature control of glue gun melt chambers generally can be achieved by use of a PTC heater. By PTC heater is meant an element with positive temperature coefficient which is to say an element which heats up when electric current is passed through it until it reaches a specific temperature, at which specific temperature electric current can no longer be passed through it due to increase of the resistance. Such heaters can be used which respond rapidly to changing temperatures and provide efficient use of electricity for heating purposes. We have now found that a most efficient usage of PTC heaters for heating a melt body having a chamber of generally circular cross-section can be achieved by use of three cylindrical PTC heaters distributed uniformly about the chamber. Preferably PTC heaters as disclosed in GB Patent Specification No. 1540482 are used and which are designed to ensure that the melt body is heated to a temperature of the order of 225° C. Suitable uniform heat distribution can be achieved together with desirable slim characteristics of the melt chamber if desired.

A melt body according to the invention is preferably provided with nozzle means through which melt from the outlet may be applied to a workpiece. Preferably the melt body has a threaded bore coaxial with the melt chamber into which may be threaded a suitable nozzle member. Preferably the nozzle member contains a spring loaded ball valve, which is arranged to be opened by pressure of melted material when rod is fed into the melt chamber.

A melt body according to the invention is preferably formed with an outer surface at the inlet onto which a flexible inlet tube may be secured. Preferably the inlet tube is shaped so as to be capable of forming a seal with the surface of rod fed through it. Preferably the tube is of circular cross-section and is provided with an interior lip portion through which a rod may be pushed when fed to the melt chamber.

A melt body according to the invention is capable of melting hot melt adhesives and the like supplied in the form of a rod in a comparatively rapid manner, and of delivering the melted composition in a homogenous condition of uniformly good temperature characteristics. It is believed that these desirable and advantageous characteristics are attributable primarily to the shaping and distribution of the fin elements and the spacing between them. Thus, the fin elements serve to convey heat of the melt body into required areas of the melt chamber without obstructing movement of unmelted portions of the rod into the tapering opening, and thus bring about good heat distribution in the melt chamber. Also, as mentioned above, we believe that by virtue of proximity between the fin elements, passage of melted material under pressure between the fin elements and through the slots cannot occur unless the material is adequately heated. By virtue of the distribution of the fin elements it is not possible to force the tip of the unmelted rod directly into the nozzle. In addition to these advantages for users of melt chambers according to the invention, advantages are also seen in manufacturing the melt body in view of the fact that all axes of hollow portions of the body (i.e. the melt chamber and housings) can be readily arranged to be parallel, thus permitting manufacture by a single step casting procedure from heat conductive metal alloy using a core which can be removed from the cast melt body in a single operation.

A melt body according to the invention may be employed in any suitable apparatus. However, it is preferred to incorporate a melt chamber according to the invention in a hand held hot melt glue gun, in which case one may capitalize on the advantages of quick start up and flow of melt at controlled temperature which may be achieved by use of such chamber.

A melt body according to the invention is preferably employed in a hand held hot melt glue gun provided with feeding means for feeding a rod of hot melt material in solid form, under the control of an operator, into the melt chamber. Preferably the feeding means comprise a carriage mounted for movement towards and away from the melt body, a clamp member pivotally mounted on the carriage and a trigger connected to the clamp member by connecting means and arranged to be operated by the operator to pivot the clamp member into engagement with the rod of hot melt supported by the carriage to grip the rod and, on further pressure on the trigger by the operator, to feed the rod into the melt chamber.

The invention provides in another of its aspects apparatus for melting and dispensing composition supplied in the form of a rod comprising a melt body according to the invention and feeding means for feeding a rod into the chamber.

The invention provides in another of its aspects a hot melt gun comprising a melt body having a melt chamber and feeding means for feeding a rod of hot melt material in solid form, under the control of an operator into the melt chamber, the feeding means comprising a carriage mounted for movement towards and away from the melt body, a clamp member pivotally mounted on the carriage and a trigger connected to the clamp member by connecting means and arranged to be operated by the operator to pivot the clamp member into engagement with the rod of hot melt supported by the carriage to grip the rod and, on further pressure on the trigger by the operator, to feed the rod into the melt chamber, the clamp member comprising a knife member in the form of a rack providing several knife portions two or more of which may engage the rod simultaneously, and the melt body comprising a melt body according to the invention.

Preferably electrical circuitry of a glue gun according to the invention incorporates means for illuminating colored indicator lights mounted on the body of the gun when the circuitry is connected with a source of electricity, and when the melt body has been heated sufficiently for optimum melt dispensing conditions.

A glue gun according to the invention preferably incorporates a resilient mouthpiece through which rod may be supplied to the feeding means.

A preferred glue gun according to the invention can be used to dispense molten material in bond forming condition at a desired temperature and with a constitution and consistency suitable for production of adhesive bonds of consistent quality. The indicator lights provide an indication to the operator of the condition of heating of the melt chamber. The feed mechanism permits rapid feed of rod to the melt chamber with comparatively low effort, and the melt body provides for rapid melting of the rod and heating of the composition to a temperature and viscosity in which it may be caused to flow from the outlet of the melt chamber as more rod is delivered through the inlet of the melt chamber by the feeding means.

There now follows a description to be read with the accompanying drawings of one example of apparatus in the form of a hot melt glue gun incorporating a melt body according to the invention each of which apparatus, hot melt gun and melt body is illustrative of the invention. It is to be clearly understood that this illustrative gun has been selected for description by way of example to illustrate the invention and is not by way of limitation thereof.

BRIEF DESCRIPTION OF THE DRAWINGS

In the drawings:

FIG. 2 is an end view of the melt body shown in FIG. 1 viewed from an outlet end of the melt body;

FIG. 3 is a view in section of the melt body indicated in FIG. 1, taken on the line 111—III of FIG. 2 and viewed in the direction of the arrows;

FIG. 4 is a view in section of the melt body, taken on the line IV—IV of FIG. 3 and viewed in the direction of the arrows;

DESCRIPTION OF THE PREFERRED EMBODIMENT

Figure 1:
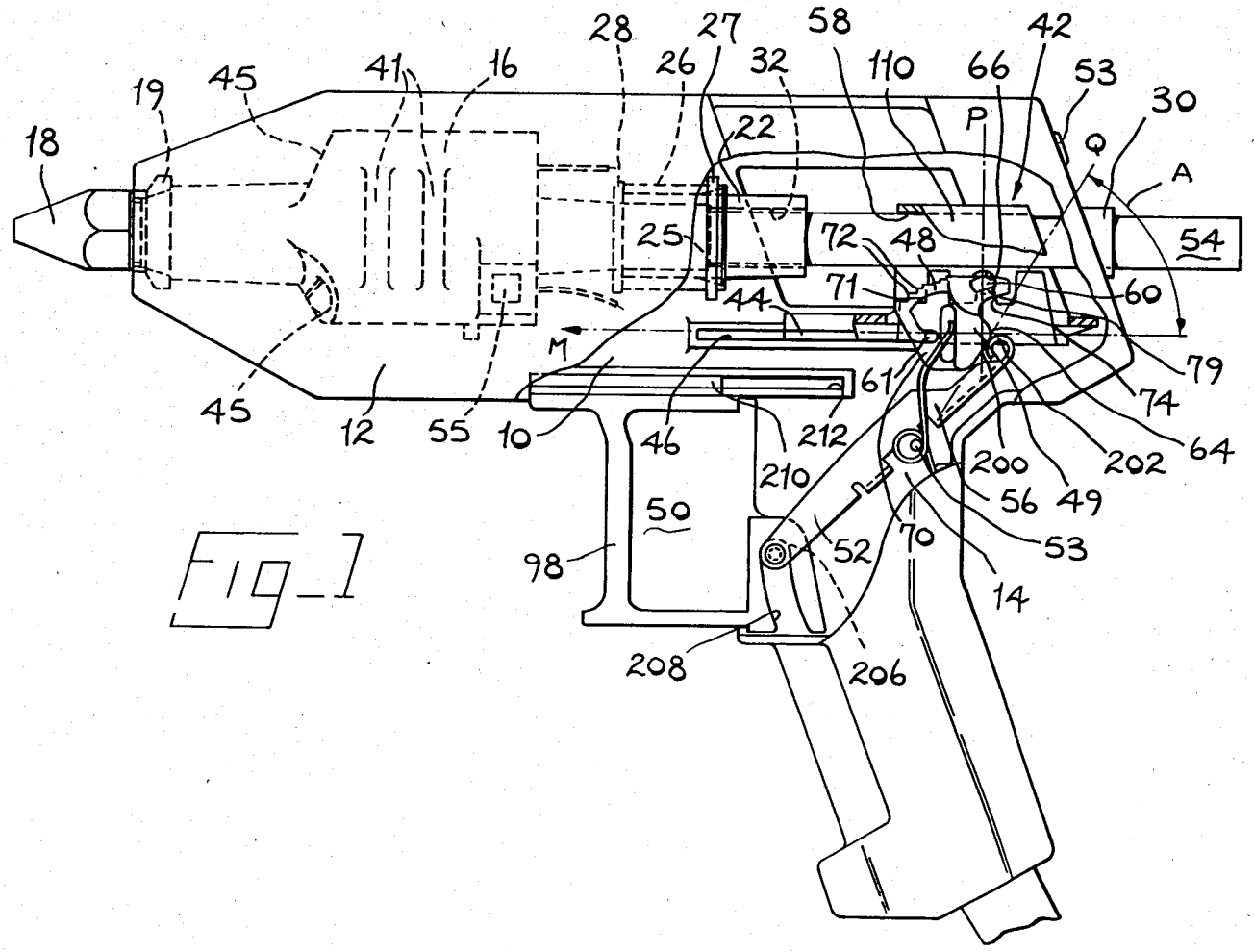
FIG. 1 is a side view of the illustrative apparatus with some parts broken away and others in section showing a rod of hot melt adhesive about to be fed to a melt body of the apparatus.
Figure 5:
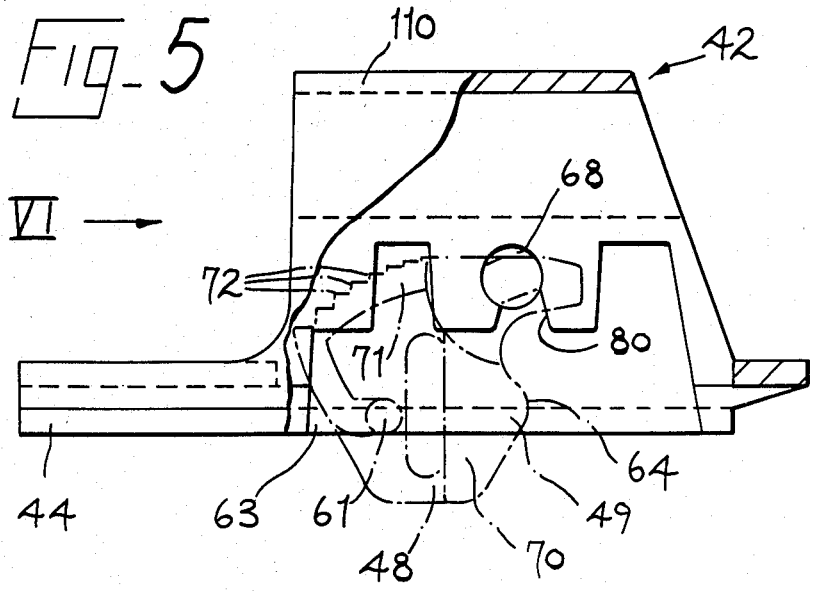
FIG. 5 is a view of a carriage of clamping means of the illustrative gun showing a clamp member in chain dotted lines in position prior to a feed stroke of the clamping means.

The illustrative gun is intended for use with rods of composition of circular cross-section and comprises a gun body having two parts 10, 12; the part 12 of the body is broken away in FIG. 1 to show feeding means 14, and other parts of the illustrative apparatus. As well as the feeding means the glue gun has a melt body 16 containing a melt chamber 17, electrically operated heating means for heating the melt body, and a nozzle 18 through which molten hot melt is expelled from the melt chamber.

The melt body 16 is of a heat conductive alloy and is formed with a generally cylindrical melt chamber 17 (FIGS. 2, 3 and 4) in which solid composition fed to the chamber as a rod may be melted. The chamber has a circular inlet 19 through which rod enters the chamber, and an outlet 21 from which melted composition may be dispensed. Fin elements 23 are disposed lengthwise within the chamber and extend from a location adjacent to the inlet to the outlet. The fin elements 23 protrude from a wall surface of the chamber into a cavity of the melt chamber and extend in directions parallel to the axis of the melt chamber and increase in size towards the outlet. The fin elements comprise major fin elements 27 and sub elements 35, each of which fin elements has a plate like structure having a substantially triangular configuration (see FIGS. 3 and 4). The fin elements comprise three major elements 27 of similar shape and size spatially disposed with angles of at least substantially 120° between adjacent major elements and which have portions of their larger ends joined together at the outlet 21. As can be appreciated the major elements 27 are arranged as a tripod within the melt chamber which is effective at least towards the outlet 21 of the melt chamber to separate the melt chamber into three sub-chambers and so that inner edge surfaces 29 of the major elements provide surface portions of a substantially pyramid shaped opening 31 centrally disposed in the chamber and which narrows to a peak 33 located adjacent to the outlet 21. The fin elements also comprise six sub elements 35 disposed in pairs at 120° C. to each other between adjacent major elements, which also have their larger ends joined together at the outlet 21. Each sub element is disposed parallel to the adjacent major element. Inner edge surfaces of the sub elements 35 also provide surface portions of the substantially pyramid shaped opening 31. The fin elements also comprise singular elements 37 disposed on the wall surface of the melt chamber equidistant from adjacent major elements. The singular elements are substantially triangular in both the widthwise and lengthwise direction and increase in size progressively towards the outlet 21. The joins between the major elements 27 and between the sub elements 35 extend over a comparatively short length of the melt chamber, thus to provide a short outlet 21 having a series of exit slots 24 (see FIG. 2) bounded by the fin elements and disposed about the axis of the melt chamber. As can be seen from the drawings, the slots are arranged about the axis of the melt chamber and about the axis of the pyramid opening, and there is no exit slot located on the axis of the melt chamber.

The melt body of the illustrative gun is intended for use with rods of hot melt adhesive of 11.5 mm diameter ±0.2 mm and which have a melt viscosity of about 10 pascal seconds at 180° C. and not more than about 50 pascal seconds at 150° C. for example Bostik Thermogrip 9951 (melt viscosity 46 pascal seconds at 150° C.), Bostik Thermogrip 9990 (melt viscosity 40 pascal seconds at 150° C.). The spacing between the fin elements at the outlet is such that the slots 24 and 35 are approximately 1 mm wide and the slots 17 are about 1.8 mm wide. With this arrangement we have found that irrespective of feeding force applied, Bostik Thermogrip 9951, and Bostik Thermogrip 9990 cannot be extruded through the outlet slots unless heated to a temperature of about 150° C. However, when such temperatures are reached it is possible to dispense from the illustrative gun amounts of melt of the order of 20 to 24 g/60 seconds during continuous feeding of rod to the melt chamber.

The melt body comprises three housings 39 each having a bore having an axis parallel to the axis of the melt chamber for receiving electrically operated heating means in the form of cylindrical self regulating heaters 45 (FIG. 1) comprising PTC resistors distributed about the chamber. The heaters 45 are of a kind substantially as described in GB Patent Specification No. 1540482 and are constructed and arranged so that the melt body may be heated to a maximum temperature of about 225° C. Suitable uniform distribution of the heaters is achieved in the melt body shown together with desirable slim characteristics of the melt body. Webs 41 and 43 formed between pairs of the housings serve to strengthen the melt body. Locating bosses 55 (FIG. 2) formed on the melt body co-operate with sockets formed in the body parts 10 and 12.

The melt body has a threaded bore 47 coaxial with the melt chamber into which the nozzle 18 is threaded. The nozzle member contains a spring loaded ball valve (not shown) which is arranged to be opened by pressure of melted material when rod is fed into the melt chamber.

An outer surface of the melt body at the inlet is formed to provide a tube 25 onto which a flexible inlet tube 22 is secured (FIG. 1). The inlet tube 22 is formed from resilient heat resistant material and has a flange 28 at its forward end and is maintained in place on the tube by a bell shaped sleeve 26. The inlet tube 22 has an inlet passage coaxial with the melt chamber in the melt body through which a rod 54 of hot melt material, for example an adhesive or sealant, may be introduced into the inlet end of the melt chamber. The inlet tube 22 is of circular cross section and is formed with an inner lip portion 32, so that as well as guiding the rod of hot melt into the melt chamber, the tube forms a seal with the surface of the rod, militating against escape of molten hot melt material from the inlet when the rod is fed into the chamber.

A locating ring 19 of resilient heat resistant material encircles a forward portion of the melt body adjacent the nozzle and is received in co-operating recesses formed in the body portions 10 and 12. The sleeve 26 is formed with a locating ring 27 which is received in co-operating grooves formed in the body portions 10 and 12. The melt body is thus mounted in the body portions 10 and 12 at its outlet and inlet ends by means of the rings 19 and 27 and at a mid portion by means of the bosses 55.

A resilient mouthpiece in the form of a guide collar 30 is mounted in the body of the gun at the rear and has a guide opening therethrough coaxial with the melt chamber to guide a rod of hot melt and maintain the rod properly aligned with the melt chamber as it is supplied to the feeding means. The inlet tube 22 guide collar 30 and ring 19 are conveniently made of silicone rubber.

The parts 10, 12 of the gun body are moulded of tough plastics material. The two parts 10, 12 of the body are secured together by fastenings included screws (not shown).

The feeding means 14 (FIGS. 1 and 5 to 9) of the illustrative gun comprises clamping means comprising a carriage 42, mounted for sliding movement towards and away from the melt body 16, by means of flanges 44 which engage in slideways 46, moulded in the gun body parts 10, 12 parallel with the axis of the melt chamber. It will be apparent that the carriage is thus arranged to move in a direction M defined by the flanges 44 and slideways 46 parallel to the axis of the melt chamber. The feeding means 14, further comprises a clamp member 48, pivotally mounted on the carriage 42, and a trigger 50 for actuating the clamp member 48 via a lever 52.

The carriage 42 comprises an upstanding part 110 having a guide aperture 58 through which the rod 54 passes, with a small clearance, as it is fed to the melt chamber. The rod is thus supported by the upstanding part 110. The clamp member 48 has a clamping arm portion 71 extending generally in the direction of rod feed by which the rod may be engaged in the operation of the feeding means to feed the rod into the melt chamber. In order that the clamp member may adequately grip the rod without unduly indenting the rod as it is fed even under substantial triggering and despite variations in diameter of the rod, and thus to minimise the risk that the seal between the flexible inlet tube 22 and the rod may be rendered ineffective to prevent blow back of melted material from the melt chamber under pressure of advancing rod, a rod engaging surface of the clamping arm portion has a somewhat arcuate configuration. The surface is serrated in order to enhance gripping of the rod, the serrations taking the form of several knife portions 72 disposed transversely of the direction of rod feed. These are arranged so that one or more and preferably not less than two may engage the rod during feeding. The rod engaging surface is located so that on operation of the trigger at least two of its knife portions are swung into contact with the rod, even though the rod may be under or oversized compared with standard diameter rod.

The clamp member 48 is provided by a casting having trunnion pins 60, by which the clamp member is pivotally mounted in the carriage 42, and stabilizer pins 61 located for movement heightwise in guideways 63 in the carriage to an extent limited by stop surfaces of the guideways. The trunnion pins are located at an upper, rearward portion of the clamp member 48. The clamp member is provided with a crank arm 70 having an operating portion in the form of a cam lobe 49 having a convex curved surface 64 located below the trunnion pins as viewed in FIGS. 1, 5, 7, 8 and 9, and disposed so that when the feed mechanism is in its rest position as shown in FIG. 1, the curved surface 64 is rearward (considered in the direction of rod feed) of a plane P normal to the direction of rod feed and extending through centre lines of the trunnion pins.

The lever 52 is mounted on a peg 53 formed in the part 10 of the gun body for pivotal movement about the peg. An upper end portion of the lever is formed as a cylindrical cam surface 202 arranged to provide pressure means to co-operate with the cam lobe 49. A lower end portion of the lever is provided with a roller bearing 206 received in a curved slot 208 formed in a rearward portion of the trigger 50 arranged so that pressure exerted to rotate the connecting lever 52 is varied with increased travel of the trigger during a feeding movement. In the rest position shown in FIG. 1, an angle A between a plane Q which includes the line of contact between the curved surface 64 and the cam surface 202 and a plane which includes the direction M in which the carriage is arranged to move, is acute as can be seen from FIG. 1.

The trigger 50 is formed with flanges 210 received in slideways 212 formed in the body parts 10, 12. The trigger and lever are so arranged as to facilitate entry of the roller bearing 206 into the open end of the slot 208 during assembly without risk of disassembly when the apparatus is in use. The trigger 50 is moulded of a hard tough plastics material. The trigger 50 has a pressure plate 98 arranged to be contacted by the finger of an operator to operate the trigger 50. The extent of movement of the trigger is restricted by engagement of the pressure plate 98 with the gun body and by engagement of a stop member 100 also moulded integrally with the trigger 50, with the parts 10, 12 of the gun body.

The trigger 50 is arranged to be operated by the operator to pivot the clamp member 48 about the trunnion pins 60 to bring knife portions 72 into engagement with the rod 54 of solid hot melt material supported by the carriage 42, inlet sleeve 22, and guide collar 30 to grip the rod 54 and, on further pressure on the trigger 50 by the operator, to feed the rod 54 into the melt chamber.

Figure 7:
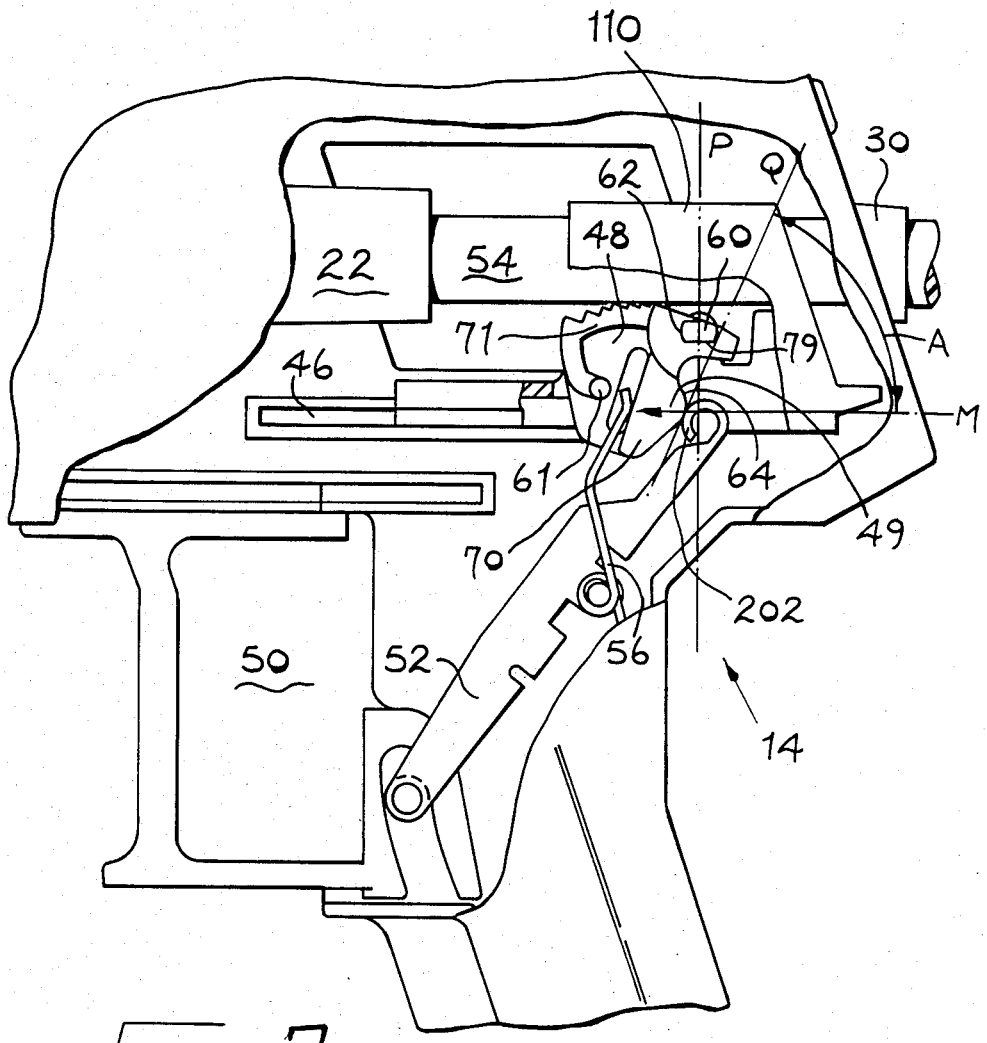
FIG. 7 is a view of feeding means of the illustrative gun with some parts broken away, showing parts in positions occupied prior to a feeding stroke to feed rod to a melt chamber of the gun.
Figure 8:
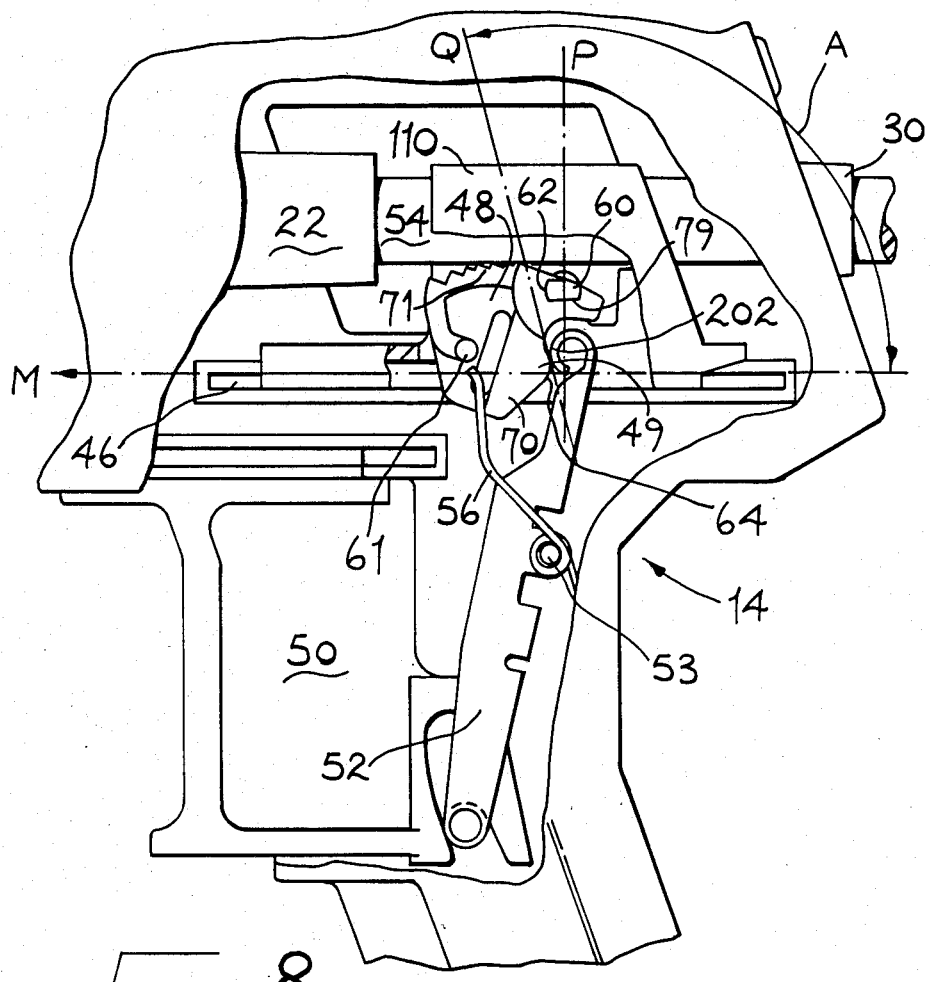
FIGS. 8 and 9 are views of the feeding means similar to FIG. 7 but showing parts in positions occupied part way through a feeding stroke and at the end of a feeding stroke respectively.
Figure 9:
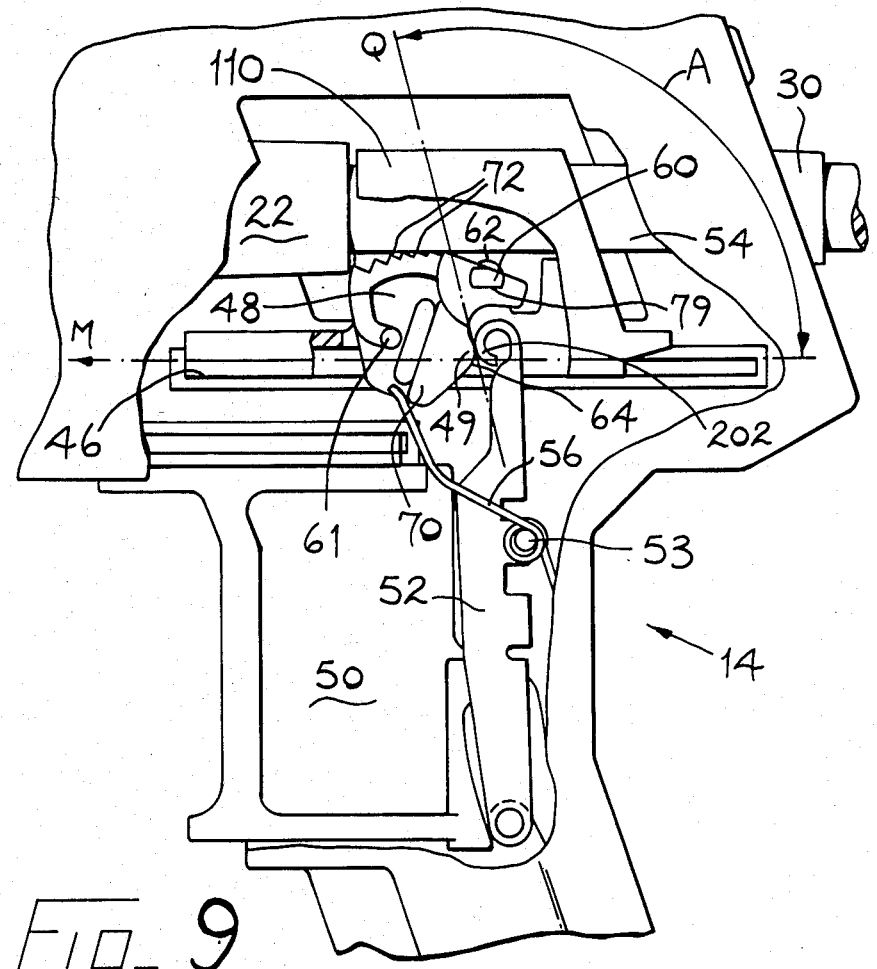

Viewing FIG. 1, when the trigger is moved rearwardly, the lever 52 is caused to rotate in a counter clockwise direction about the peg 53. The cam surface 202 is thus caused to move in an arc towards the melt body and to press upon the cam lobe 49. Initial pressure causes the clamp member to rotate clockwise about the axis of the trunnion pins 60, to an extent limited by engagement of knife portions 72 against the rod. Continued pressure causes the rod to become gripped between the knife portions and the upstanding part 110. During clockwise rotation of the clamp member the disposition of the cam lobe 49 is altered not only in relation to the cam surface 202 but also in relation to the plane P inasmuch as the cam surface 202 engages a portion of the curved surface higher than initially and also the curved surface 64 is moved to a location forward of the plane P (FIG. 7). Also, the angle A becomes less acute, i.e. is increased. Further movement of the cam surface 202 causes the clamp member to act on the carriage 42 to move it towards the melt body, with the rod gripped between the knife portions and the upstanding part. During this movement the cam surface rides up the cam lobe into a region where the angle A has become obtuse (see FIGS. 8 and 9) and pressure is exerted primarily in a direction to move the carriage forward in the direction of rod feed. By virtue of the disposition of the pivots and the clamping arm and of the shaping of the cam lobe, there is brought about a locking of the clamp member to the rod which is beneficial in reducing the effort needed for gripping the rod.

The feeding means 14 comprises a spring 56 extending between an elongate slot in the clamp member 48 and the lever pivot 53, by which the clamp member 48 is biased in a counter clockwise direction as viewed in FIG. 1 and the carriage 42 is biased away from the melt body 16. At the end of a feeding stroke, the trigger may be released, and the spring is effective to swing the clamp member about the pins 60 to lower the clamping arm from the rod and return the clamp member, carriage and lever 52 to their initial positions as shown in FIG. 1 preparatory to another feed stroke.

Figure 6:
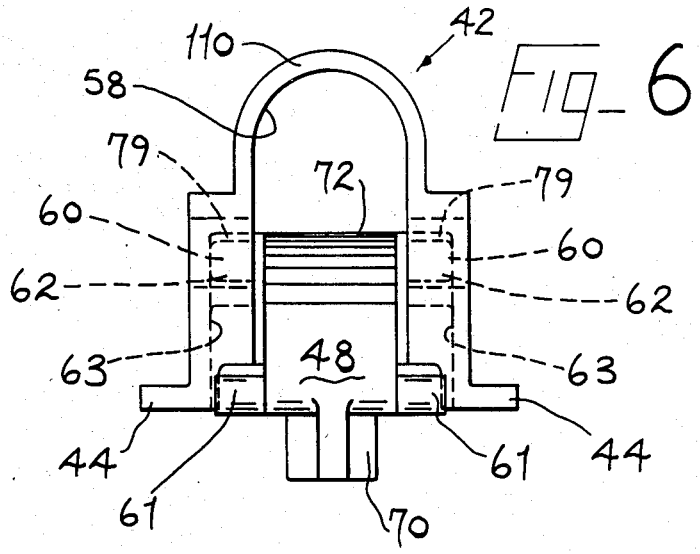
FIG. 6 is a view of the carriage and clamp member of the illustrative gun taken in the direction of the arrow VI on FIG. 5.

The feeding means 14 comprising the carriage 42, clamp member 48, lever 52, trigger 50, and spring 56 are constructed such that they can all be assembled to one another and into the parts 10, 12 of the glue gun body without further equipment or fastening means. The feeding means 14 has been designed to have as few parts as possible and to be assembled reliably and simply in such a way that when the parts 10, 12 of the gun body are secured together the feeding means remains securely assembled. Each of the trunnion pins 60 has two arcuate coaxial bearing portions 62 and two parallel flat faces 79 at opposite sides of the pin 60 (FIG. 6). The pivot pins 60 are arranged to be received in coaxial bearing openings 66 at opposite sides of the carriage 42, (FIG. 6) the bearing openings 66 being defined by circular bearing surfaces 68 against which the bearing portions 62 of the pins 60 are supported. Each of the bearing surfaces 68 has an assembly opening 80 extending around a minor arc in the surface remote from the rod 54 of hot melt supported by the carriage 42, the assembly openings 80 being sufficiently wide for the pivot pins 60 to pass through the assembly openings 80 when the flat faces 79 of the pins 60 are suitably oriented relative to the assembly opening 80 (with the flat faces 79 generally parallel to a radius of the bearing openings 66 bisecting the assembly openings 80), but when assembled in the gun, the arc of pivotal movement of the knife member 48 being restricted so that the pivot pins 60 cannot reach an orientation where the flat faces 79 are sufficiently aligned with the assembly opening 80 to permit the pins 60 to be withdrawn, or escape, through the assembly opening 80.

The feeding means 14 can be assembled simply: the trigger 50 is assembled with the lever 52, and assembled to the body part 10. The clamp member 48 is assembled with the carriage 42 by introduction of the pivot pins 60 into the bearing openings 66, and the carriage is mounted with slide 44 in the slideways 46 of the body part 10. The spring 56 is assembled with the clamp member and the peg 53. When the feeding means 14 is assembled, the carriage 42 will be urged by the spring 56 to a rear-most position along the slideway 46 and the clamp member will be urged in a counter-clockwise direction, so that the knife portions 72 are lowered with respect to the carriage and the trigger will be urged to an outward position. The stop member 100 will engage the part 10 of the body, preventing further clock-wise movement of the lever (viewing FIG. 1): the orientation of the knife member 48, relative to the carriage 42, is such that the pins 60 are unable to escape from the bearing opening 66 through the assembly opening 80 and likewise the lever 52 is unable to reach an orientation which would allow the bearing, 206 to escape from the slot 208. When the feeding means 14 and the other parts of the glue gun, including the melt body 16, inlet sleeve 22, guide collar 30, electric leads and heater element, are properly assembled in the part 10 of the gun body the part 12 of the body is aligned with the part 10 and the two parts secured together.

When the trigger is moved rearwardly of the gun by pressure on the pressure plate 98, the lever 52 is caused to pivot about the peg 53 and to bring about pivotal movement of the clamp member on the carriage and sliding movement of the carriage as described above.

Maximum depression of the trigger is governed by contact of the pressure plate 98 with the body parts 10, 12, in which condition the upstanding part 110 of the carriage 42 is adjacent an inlet end of the inlet tube 22. When the trigger 50 is released the knife portions are disengaged from the rod and the rod is released from the upstanding part 110 of the carriage 42. The rod 54 is restrained against movement rearwardly by the collar 30 and inlet tube 22. The carriage 42 slides rearwardly under the pressure of the spring 56 to an extent determined by engagement of the stop member 100 with the body part 10, 12 the carriage sliding relative to the rod 54 so that on a subsequent operation of the trigger 50 a fresh part of the rod 54 is gripped by the knife portions 72 and upstanding part 110 of the carriage 42. As the rod 54 is urged into the melt chamber by the feeding means 14, heat supplied to the melt body 16 by the heating element melts the material of the rod 54 and the molten material is dispensed through the nozzle 18 under pressure applied by the feeding means 14 to the rod 54. Relaxation of pressure on the trigger 50 stops feed of rod 54 into the melt chamber and thus molten material ceases to be dispensed through the nozzle 18.

The illustrative apparatus comprises electrical circuitry for connecting the heaters to a source of electricity. The circuitry incorporates means for illuminating two colored neon indicator lamps 53 mounted on the body of the gun. One of the lights is arranged to be illuminated when the circuitry is connected with a source of electricity, and the other of the lights is arranged to be illuminated (due to operation of a PTC sensor in co-operation with the switching point of the neon lamp) when the melt body has been heated to 180° C., which is regarded as sufficient for optimum melt dispensing conditions for many glue sticks.

When it is desired to use the illustrative apparatus, the circuitry is connected to an electrical power source, and a rod 54 of hot melt adhesive of circular section is pushed into the apparatus through the guide collar 30, between the upstanding part 110 and the clamp member 48, into the inlet tube 22, where it is gripped by the distended lip 32 of the inlet tube 22, and into the inlet of the melt chamber. Operation of the trigger when material in the melt chamber is melted (i.e. indicator lights have been illuminated) brings about feeding of the rod as aforesaid. As rod is fed into the melt chamber, its leading end and outer surface are first softened and melted, leaving a substantially cone-like solid residue which during continued feeding is forced onto the inner edge surfaces of the fin elements. Thus, the melt chamber walls and the fin elements transfer heat to the composition. As progressively more rod is fed into the melt chamber, it serves to force heat softened or melted material before it between the fin elements and through the slots of the outlet and ultimately from the nozzle. As the material is forced between the fin elements heat transfer from the fin elements continues and the material is further heated.

We claim:

1. A heat conductive melt body comprising a chamber for melting solid composition provided in the form of a rod the chamber having an inlet through which a rod of composition may be inserted into the chamber and an outlet from which melted composition may be dispensed, fin elements disposed lengthwise within the chamber and of progressively increasing size considered in a direction extending from the inlet to the outlet, the fin elements being so shaped and located that edge surfaces thereof disposed towards an interior of the chamber define surface portions of an opening of progressively reducing cross section the peak of which opening is located adjacent to the outlet but on the inlet side thereof and so that end portions of the fin elements at the outlet are spaced to define a series of exit slots spaced about an axis of the opening to provide the outlet, and at least one housing for receiving electrically operated heating means for heating the melt body.

2. A melt body according to claim 1 wherein the slots are of a size such that material of viscosity greater than 50 pascal seconds at 150° C. does not readily flow through the slots.

3. A melt body according to claim 1 wherein the fin elements comprise three major elements of similar triangular configuration, the elements of which are spaced apart by 120° one from the next.

4. A melt body according to claim 3 wherein each fin element is of triangular configuration.

5. A melt body according to claim 1 wherein the inlet is circular and the chamber is substantially cylindrical.

6. A melt body according to claim 1 wherein said opening is shaped as a three sided pyramid, and wherein at least the major fin elements extend from adjacent to the inlet to the outlet.

7. A melt body according to claim 1 comprising three housings disposed about the chamber.

8. A melt body according to claim 7 wherein each housing contains a PTC heater.

9. A melt body according to claim 1 provided with a threaded bore adjacent the outlet for receiving a threaded nozzle element.

10. A melt body according to claim 1 comprising a resilient inlet tube secured to the melt body at the inlet thereof.

11. Apparatus for melting and dispensing composition supplied in the form of a rod comprising a melt body according to any of claims 1 to 10 and feeding means for feeding a rod into the chamber.

12. Apparatus according to claim 11 in the form of a hot melt gun.

13. A hot melt gun comprising a melt body having a melt chamber and feeding means for feeding a rod of hot melt material in solid form, under the control of an operator into the melt chamber, the feeding means comprising a carriage mounted for movement towards and away from the melt body, a clamp member pivotally mounted on the carriage and a trigger connected to the clamp member by connecting means and arranged to be operated by the operator to pivot the clamp member into engagement with the rod of hot melt supported by the carriage to grip the rod and, on further pressure on the trigger by the operator, to feed the rod into the melt chamber, the clamp member comprising a knife member in the form of a rack providing several knife portions two or more of which may engage the rod simultaneously, and the melt body comprising a melt body according to any one of claims 1 to 11.

14. A hot melt gun according to claim 13 comprising a resilient mouthpiece through which rod may be supplied to the feeding means.

15. A heat conductive melt body comprising a chamber for melting solid composition provided in the form of a rod, the chamber having an inlet through which a rod of composition may be inserted into the chamber and an outlet from which melted composition may be dispensed, fin elements comprising three major elements of similar triangular configuration, spaced apart by 120° one from the next, and subelements arranged in pairs between adjacent major elements and parallel thereto, said fin elements being disposed lengthwise within the chamber and of progressively increasing size considered in a direction extending from the inlet to the outlet, and being so shaped and located that edge surfaces thereof disposed towards an interior of the chamber define surface portions of an opening of progressively reducing cross section, the peak of which opening is located adjacent to the outlet but on the inlet side thereof and so that end portions of the fin elements at the outlet are spaced to define a series of exit slots spaced about an axis of the opening to provide the outlet, and at least one housing for receiving electrically operated heating means for heating the melt body.

16. A melt body according to claim 15 wherein each fin element is of triangular configuration.

* * * * *